United States Patent [19]

Harada et al.

[11] Patent Number: 4,957,460

[45] Date of Patent: Sep. 18, 1990

[54] THRUST BEARING ARRANGEMENT FOR MARINE OUTBOARD DRIVES

[75] Inventors: Norimichi Harada; Akihiro Onoue, both of Hamamatsu, Japan

[73] Assignee: Sanshin Kogyo Kabishiki Kaisha, Hamamatsu, Japan

[21] Appl. No.: 819,759

[22] Filed: Jan. 16, 1986

[30] Foreign Application Priority Data

Jan. 31, 1985 [JP] Japan ..... 60-15415

[51] Int. Cl.[5] ..... B63H 5/13

[52] U.S. Cl. ..... 440/83; 440/75

[58] Field of Search ..... 440/75, 78, 86, 900, 440/83; 192/21, 48.91; 384/904, 590, 455, 453, 596

[56] References Cited

U.S. PATENT DOCUMENTS 3,937,093 2/1976 Johnson et al. ..... 440/78

3,968,767 7/1976 Blanchard ..... 440/75

4,302,196 11/1981 Blanchard ..... 440/75

FOREIGN PATENT DOCUMENTS 58-76397 5/1983 Japan ..... 440/78

*Primary Examiner*—Joseph F. Peters, Jr.

*Assistant Examiner*—Edwin L. Swinehart

*Attorney, Agent, or Firm*—Ernest A. Beutler

[57] ABSTRACT

A marine outboard drive and more particularly to two embodiments of improved transmission and propeller shaft thrust taking arrangements for the lower unit. In each embodiment, the forward and reverse driving thrusts are transmitted independently to the lower unit housing. In one embodiment, a single thrust flange transmits the thrust from the propeller shaft to both of the thrust bearings and in the other embodiment, the thrust is transmitted to the thrust bearings on opposite sides of the forward, reverse transmission for axially separating the driving thrusts from each other.

12 Claims, 3 Drawing Sheets

Fig-1
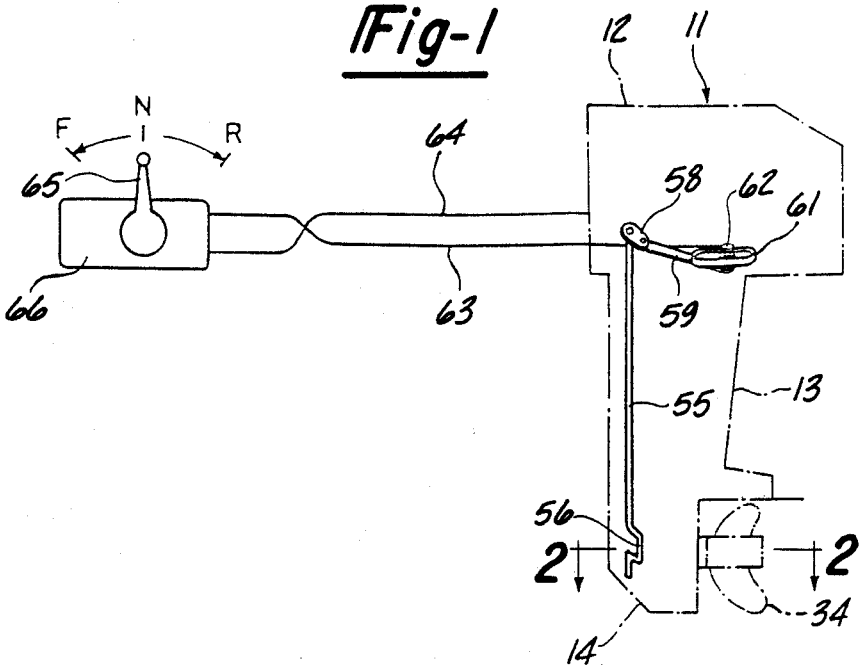
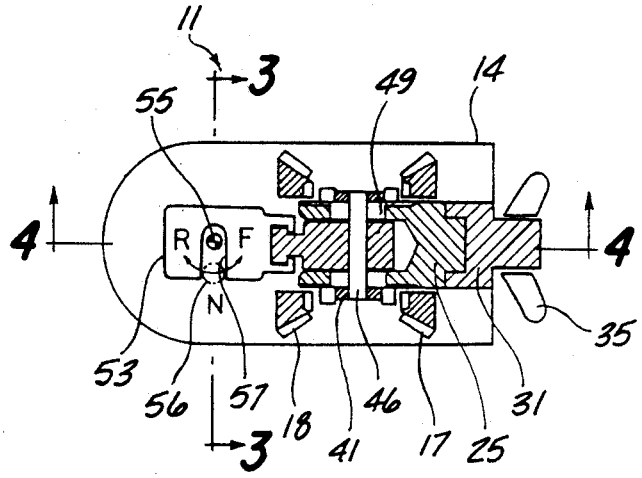
Fig-2
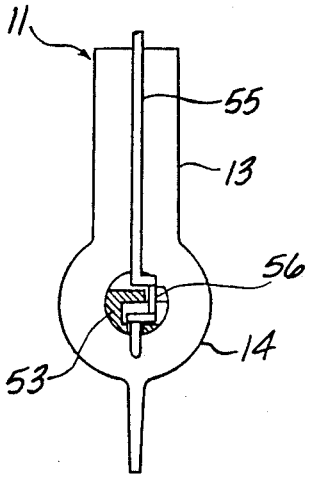
Fig-3

THRUST BEARING ARRANGEMENT FOR MARINE OUTBOARD DRIVES

BACKGROUND OF THE INVENTION

This invention relates to a thrust bearing arrangement for the propeller shaft of marine outboard drives and more particularly to an improved thrust bearing arrangement.

In marine outboard drives, be they either the lower unit of an outboard motor or the lower unit of the outboard portion of an inboard/outboard drive, it is the normal practice to embody a selectively operable forward, neutral and reverse transmission. As a result, the propeller shaft must be capable of transmitting both forward and reverse driving thrusts to the lower unit. Due to the relatively compact nature of marine outboard drives, this has presented certain problems in providing adequate thrust bearing arrangements and yet thrust bearing arrangements that will provide long life and good serviceability.

In one type of thrust bearing arrangement for such marine outboard drives, it has been the practice to employ a single thrust flange on the propeller shaft and a pair of oppositely disposed thrust bearings that cooperate with this flange so as to take both forward and reverse driving thrusts. With the prior art constructions of the type described, the thrust bearings have been held between a pair of bearing housings which are, in turn, held in engagement with the thrust bearing and flange by supporting bolts or bolt and nut assemblies. Although this arrangement provides a relatively compact configuration, the reverse loadings on the propeller shaft tend to cause the bolt and nut assemblies to work loose and the thrust bearings will become loose and worn.

It is, therefore, a principal object of this invention to provide an improved thrust bearing arrangement for a marine outboard drive.

It is a further object of this invention to provide an improved thrust bearing arrangement for marine outboard drives wherein the thrusts are transmitted by the forward and reverse thrust bearings directly to the lower unit housing and independently of each other. The term "independently of each other" is used herein to mean that the thrust from the individual thrust bearings is transmitted to the lower unit housing without the thrusts from both bearings having to pass through a common element.

Although there are some advantages in connection with the use of only a single thrust flange on the propeller shaft, such a configuration locates both the forward and reverse driving thrusts in the same area of the lower unit housing. Certain advantages may be obtained if the respective driving thrusts are confined to spaced apart areas of the lower unit housing.

It is, therefore, a still further object of this invention to provide a thrust bearing arrangement for a marine outboard drive wherein forward and reverse thrusts are transmitted to the lower unit housing at axially spaced apart locations.

In normal outboard motors or outboard drives, the forwardly disposed gear of the forward, neutral, reverse transmission is the forward driving gear and the forward driving thrusts may be transmitted directly from it to the lower unit housing. However, where there are twin outboard drives, it is the practice to employ drive shafts that drive in the same directions. As a result, the added outboard drive is operated so that its rearwardly disposed gear is the forward drive gear and a different thrust taking arrangement must be provided. One way in which this may be done is by providing a splined connection between the transmission output shaft and the propeller shaft so that the thrusts may be taken directly by the propeller shaft rather than by the gears of the transmission. This also has the advantage of reducing the thrusts which are exerted from this gear to the driving bevel gear of the transmission when the rear gear is the forward drive gear. This problem does not exist when the front gear is the forward drive gear.

It is, therefore, yet another object of this invention to provide an improved thrust taking arrangement for the added outboard drive of a twin outboard arrangement.

SUMMARY OF THE INVENTION

A first feature of this invention is adapted to be embodied in a thrust bearing arrangement for the propeller shaft of a marine outboard drive that comprises a lower unit housing, a drive shaft supported for rotation with the lower unit housing, a propeller shaft and transmission means for selectively driving the propeller shaft in forward and reverse directions from the drive shaft. In accordance with this feature of the invention, a first thrust bearing is provided for taking driving thrusts in one direction from the propeller shaft and a second thrust bearing is provided for taking the driving thrusts in the opposite direction from the propeller shaft. Means are provided for transmitting the driving thrusts from the first and second thrust bearings to the lower unit housing independently of each other.

Another feature of the invention is adapted to be embodied also in a thrust bearing arrangement for the propeller shaft of a marine outboard drive of the type as described in the preceding paragraph having the lower unit housing, the drive shaft, the propeller shaft and the selective forward and reverse transmission. In accordance with this embodiment of the invention, a first thrust bearing is provided between the propeller shaft and the lower unit housing for the taking the driving thrust in one direction and on one side of the forward, reverse transmission. A second thrust bearing is provided for transmitting the driving thrusts from the propeller shaft to the lower unit housing in the opposite direction and on the opposite axial side of the forward, reverse transmission.

BRIEF DESCRIPTION OF THE DRAWINGS

FIG. 1 is a partially schematic side elevational view of an outboard motor and transmission control constructed in accordance with an embodiment of the invention.

FIG. 2 is an enlarged cross-sectional view taken generally along the line 2—2 of FIG. 1.

FIG. 3 is a cross-sectional view taken along the line 3—3 of FIG. 2.

DETAILED DESCRIPTION OF THE PREFERRED EMBODIMENTS

Figure 4:
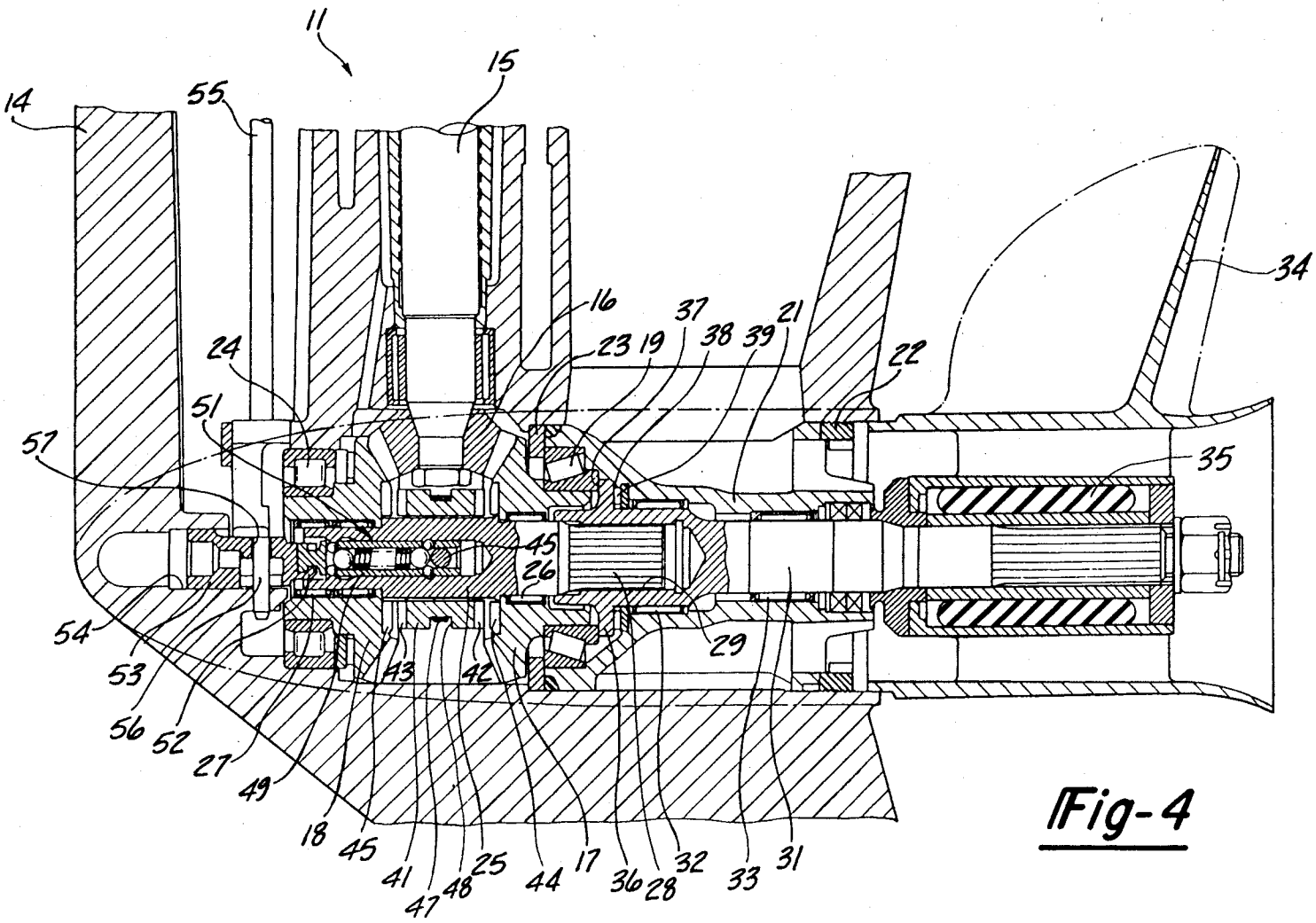
FIG. 4 is a further enlarged cross-sectional view taken along the line 4—4 of FIG. 2.

Referring first to FIG. 1, an outboard motor constructed in accordance with an embodiment of the invention is identified generally by the reference numeral 11 and is shown primarily in phantom. Although the invention is described in conjunction with an outboard motor, the invention relates to the final drive unit and specifically the lower unit and, accordingly, the invention may be practiced equally as well with the outboard drive unit of an inboard/outboard arrangement. The outboard motor 11 is particularly adapted for use as one of the two units of a twin outboard drive. The motor 11 is particularly adapted for use as the additional motor wherein the input or drive shaft rotates in the same direction as a conventional motor but wherein the propeller shaft rotates in an opposite direction and has a propeller that is of an opposite hand so as to balance the driving thrust.

The outboard motor 11 includes a power head 12 including an internal combustion engine and a surrounding protective cowling. The engine of the power head 12 drives a vertically disposed drive shaft (to be described) that extends through a drive shaft housing 13 and terminates within a lower unit 14. Contained within the lower unit 14 is a transmission mechanism which will now be described by particular reference to FIGS. 2 through 4.

The engine driven drive shaft previously referred to is identified by the reference numeral 15 and has a driving bevel gear 16 affixed to its lower end for simultaneous rotation with the drive shaft 15. A pair of driven bevel gears 17 and 18 are in mesh with diametrically opposite sides of the driving bevel gear 16 so that the driven gears 17 and 18 will rotate in opposite directions upon rotation of the driving gear 16.

The driven bevel gear 17 has its hub portion rotatably journaled by means of a tapered roller thrust bearing 19 which is, in turn, carried in a bearing carrier 21. The bearing carrier 21 is held in position within an internal cavity of the lower unit housing 14 by means including a retaining nut 22. The opposite end of the thrust bearing 19 and specifically its outer race is engaged with a thrust stop 23 that is affixed between the bearing carrier 21 and the housing of the lower unit 14.

The driven bevel gear 18 has its hub portion journaled in the housing of the lower unit 14 by means of a roller bearing assembly 24. The driven gears 17 and 18, in turn, rotatably journal an intermediate shaft 25 by means of axially spaced needle bearings 26 and 27, respectively. The intermediate shaft 25 has a splined rear end 28 which is received within an internally splined opening 29 formed in an enlarged portion of a propeller shaft 31. The propeller shaft 31 is journaled within the bearing carrier 21 by means of a pair of axially spaced needle bearings 32 and 33. Because of the use of the two axially spaced bearing assemblies 32 and 33, the propeller shaft 31 will be rigidly held and not in a cantilevered manner as with certain prior art constructions. In addition, the needle bearing 32 engages the larger diameter portion of the propeller shaft 31 that is formed with the internal splines 29 so as to provide a good load bearing capability.

A propeller 34 is affixed to the exposed rear end of the propeller shaft 31 by means of a torsionally resilient coupling 35. The normal direction of rotation of the propeller shaft 31 for forward motion is the opposite as that of a conventional outboard motor because of the fact that the motor 11 is designed as the added non-conventional unit of a twin outboard drive. For that reason, the propeller 34 has an opposite hand to that of the conventional propellers. In order to drive the propeller shaft 31 in such a counter direction, the gear 17 functions as the forward drive gear while in a conventional outboard drive, the drive gear 18 comprises the forward drive gear. Since the gear 17 is the forward drive gear, some arrangement should be provided so as to insure that the driving thrusts do not increase the pressure between the gears 17 and 16 and cause undue wear. The splined connection 28 serves to assist in insuring that the forward driving thrusts will not be exerted upon the gear 17 in this embodiment.

The propeller shaft 31 is provided with an annular thrust collar 36 which is integrally formed with the enlarged diameter portion and generally centrally of the internal splines 29. The thrust collar 36 has a forwardly facing thrust surface 37 that is engaged with the inner race of the thrust bearing 19 so that forward driving thrusts are transmitted from the propeller shaft 31 through the face 37 to the inner race of the bearing 19 and from the bearing 19 through the thrust sleeve 23 to the housing of the lower unit 14. In a similar manner, the thrust flange 36 is formed with a rearwardly facing surface 38 that is engaged with a needle type thrust bearing 39 which, in turn, is engaged with the bearing housing 21 so as to transfer reverse driving thrusts to the housing of the lower unit 14 through the thrust bearing 39 and bearing housing 21. Thus, the forward and reverse thrusts are taken by two different bearings and these bearings may each be sized to accommodate the respective loads. The thrusts are also independently transmitted to the housing of the lower unit 14. It should be noted that the forward driving thrusts are greater and, hence, the thrust bearing 19 is larger than the thrust bearing 39. In addition and as has been noted, the bearing 19 serves to rotatably journal the driven gear 17 and the intermediate shaft 25.

The method for drivingly coupling either of the gears 17 or 18 selectively for rotation with the intermediate shaft 25, propeller shaft 31 and propeller 34 includes a dog clutching sleeve 41 that has a splined connection to the central portion of the intermediate shaft 25. By virtue of this splined connection, the dog clutching sleeve 41 may move axially relative to the intermediate shaft 25 but is rotatably affixed to it. The sleeve 41 has oppositely facing dog clutching teeth 42 and 43 that are adapted to engage and mesh with corresponding clutching teeth 44 and 45 on the driven gears 17 and 18, respectively.

The mechanism for shifting the clutching sleeve 41 from the neutral position shown in FIGS. 2 and 4 to the engaged position with either the gears 17 or 18 includes a pin 46 that extends diametrically through the shaft 25 and into the sleeve 41. The pin 46 is held axially in position by means of a torsional spring 47 that is received within a circumferential groove 48 in the sleeve 41. The pin 46 extends through axially extending diametrically opposed slots formed in the intermediate shaft 25 so as to permit its axial movement relative to the intermediate shaft 25 while being held against rotation relative to the shaft 25.

The pin 46 is staked to one end of a shifting sleeve 49 that is slidably supported within a bore of the intermediate shaft 25. A detent mechanism, indicated generally by the reference numeral 51 and having a construction as described in copending application Ser. No. 503,570, filed June 13, 1983, entitled "Detent Mechanism For Clutches", and assigned to the same assignee of this application, is provided for holding the dog clutching sleeve 41 and shifting sleeve 49 in the neutral position and for assisting in the movement of the dog clutching sleeve 41 into engagement as described in that copending application which is incorporated herein by reference.

A tongue and groove connection 52 connects the forward end of the shifting sleeve 49 to a shifting cam assembly 53. The cam assembly 53 is supported for reciprocation within a bore 54 of the housing of the lower unit 14. The tongue and groove connection 52 permits rotation of the shifting sleeve 49 relative to the shifting cam 53 while coupling these two elements together for simultaneous axial movement.

A shift rod 55 extends vertically through the drive shaft housing and has a crank shaped portion 56 at its lower end. The crank shaped portion 56 is received in a slot 57 in the cam 53 so that rotation of the shifting rod 55 will cause reciprocation of the shifting cam 53 and, accordingly, of the shifting sleeve 49 and dog clutching sleeve 41 to engage either the gear 17 or the gear 18 for rotation with the intermediate shaft 25 and the propeller shaft 31.

A link 58 is affixed to the upper end of the shifting rod 55 and is, in turn, connected to a second link 59 which carries a cam groove 61 at its outer end. An actuator element 62 is received in the cam groove 61 and is connected to a pair of flexible transmitters 63 and 64. The flexible transmitters 63 and 64 are connected at their forward end to a shift lever 65 of a shift control mechanism 66 that is positioned within the associated watercraft in proximity to the operator. The shift lever 65 is shiftable from the neutral position as shown in FIG. 1 in a forward direction to the forward transmission ratios selecting position. During such forward movement, the shifting rod 55 rotates in a counterclockwise direction so as to urge the shifting cam 53 and shifting sleeve 49 rearwardly so that the dog clutch teeth 42 engage the dog clutching teeth 44 and forward drive is selected. Movement of the shift lever 65 in the rearward direction accomplishes forward movement of the shifting cam 53 and the dog clutching teeth 43 will engage the dog clutching teeth 45 and select reverse gear of the transmission. As has been noted, the forward driving thrust from the propeller 34 is transferred through the propeller shaft 31 and thrust collar 37 to the thrust bearing 19. However, the intermeshing bevel gears 16 and 17 exert a force in the opposite direction upon the thrust bearing 19. Therefore, the actual axial thrust carried by the bearing 19 is reduced by the fact that the two thrusts acting in opposite directions are transferred directly to it.

Figure 5:
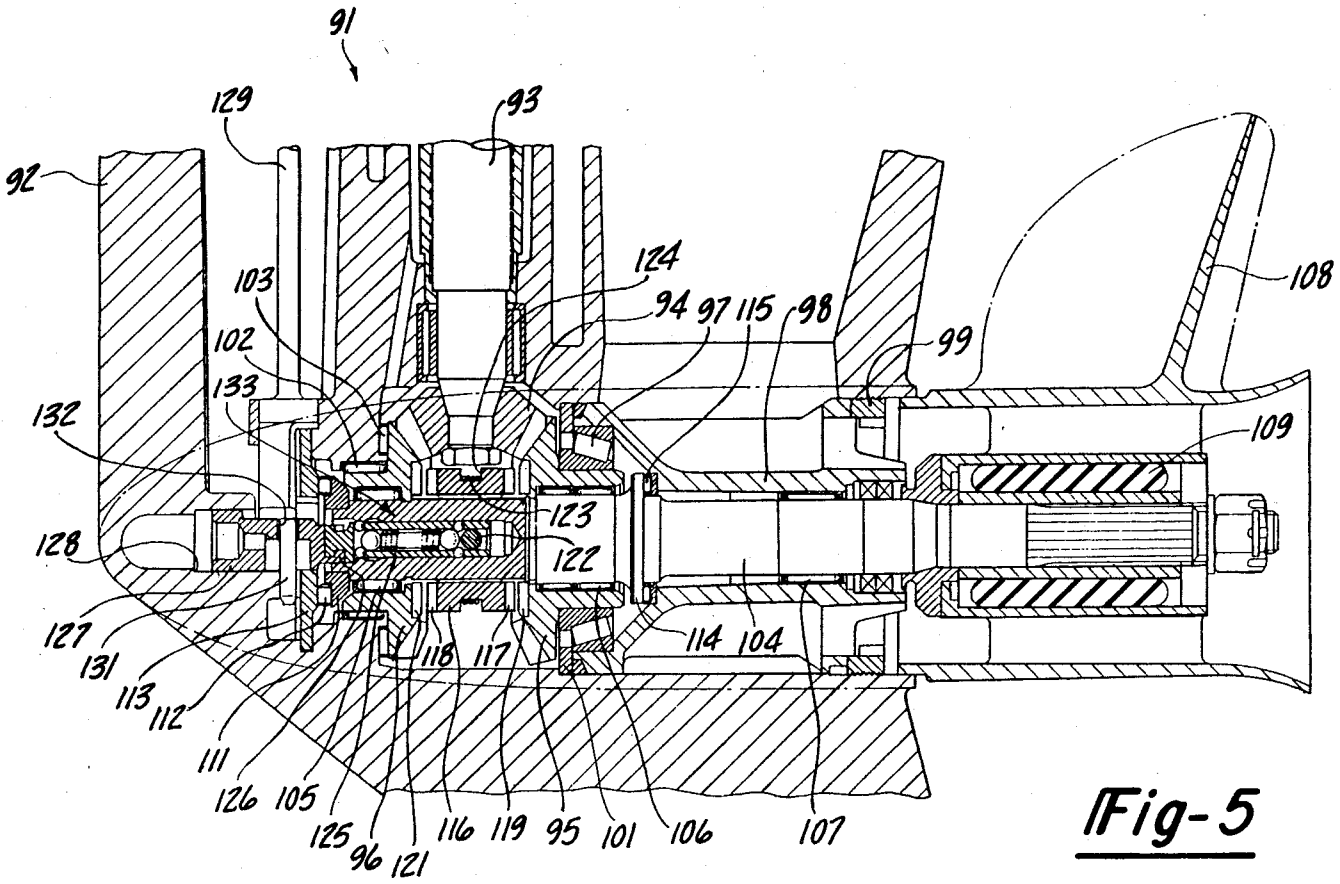
FIG. 5 is an enlarged cross-sectional view, in part similar to FIG. 4, showing a second embodiment of the invention.

In the embodiment of FIGS. 1 through 4, the forward and reverse driving thrusts were transmitted from the propeller shaft to the lower unit housing from a single thrust flange that was formed integrally on the propeller shaft. Although this may have some advantages, there may be certain advantages in connection with transmitting the thrusts in the forward and reverse directions from the propeller shaft to the lower unit housing at axially spaced positions. By separating the thrust taking locations, it is possible to avoid the splined connection as utilized in the previously described embodiment. Such an embodiment is shown in FIG. 5. In connection with the embodiment of FIG. 5, only the lower unit assembly has been illustrated and is identified generally by the reference numeral 91. The mechanism for shifting the transmission and its association with the remaining components may be considered to be the same as the embodiment of FIGS. 1 through 4 and, for that reason, these components have not been illustrated.

In this embodiment, a lower unit housing 92 rotatably journals the lower end of the engine driven drive shaft 93. The drive shaft 93, in turn, has affixed to its lower end a driving bevel gear 94. The driving bevel gear 94 is engaged with a pair of diametrically opposed oppositely rotating bevel gears 95 and 96. Like the embodiment of FIGS. 1 through 4, the outboard motor illustrated is designed to be utilized as the additional nonconventional motor of a twin outboard drive and hence the propeller shaft normally rotates in an opposite direction to a conventional outboard motor during forward drive and the propeller has an opposite hand.

The driven bevel gear 95 has its hub portion rotatably journaled within a combined roller and thrust bearing 97 of the tapered roller type. The thrust bearing 97 is, in turn, supported within a bearing housing 98 that is contained within the lower unit housing 92 and which is axially held in place by means of a retainer nut 99 which encircles the opening at the rear end of the lower unit 91. The outer race of the thrust bearing 97 is engaged with a thrust collar 101 that is contained within the lower unit housing and is axially held in place by the bearing housing 98.

The driven bevel gear 96 has its hub portion rotatably journaled within the lower unit housing 92 by means of a needle bearing assembly 102. In addition, a needle type thrust bearing 103 is interposed between the forward face of the driven bevel gear 96 and the lower unit housing 92 for taking the driving thrusts on the driven bevel gear 96.

A propeller shaft indicated by the reference numeral 104 is journaled within the lower unit housing by means of a first needle bearing assembly 105 that is positioned between the interior of the driven bevel gear 96 and the forward end of the propeller shaft 105, a second needle bearing assembly 106 that is positioned between the hub of the driven bevel gear 95 and the intermediate portion of the propeller shaft 104 and a third needle bearing assembly 107 that is disposed between the bearing carrier 98 and the rearward end of the propeller shaft 104.

Rearwardly of the bearing 107, the propeller shaft 104 extends through an opening in the lower unit housing and is rotatably coupled to a propeller 108 by means of a torsionally resilient coupling 109.

Forward driving thrusts are transmitted from the propeller shaft 104 to the lower unit housing 92 forwardly of the driven bevel gears 95 and 96 by means of a thrust collar 111 that is engaged with a forward shoulder of the propeller shaft 104 and which forms a portion of a thrust bearing arrangement 112. The thrust bearing arrangement 112 also includes a forward race 113 that is in thrust transmitting engagement direction with the lower unit housing 92 so as to transmit the forward driving thrust directly to the housing 92 forwardly of the forward, neutral, reverse transmission.

Rearward driving thrusts are transmitted to the lower unit housing 92 rearwardly of this transmission by means including a thrust flange 114 that is formed integrally with the propeller shaft 104. The flange 114 engages a needle type thrust bearing 115 which, in turn, transfers its thrust to the bearing housing 98 and from the bearing housing to the lower unit housing 92 through the retaining nut 99. Hence, it should be readily apparent that the forward and reverse driving thrusts are transmitted directly and independently to the lower unit housing 92 on axially spaced opposite sides of the forward, neutral, reverse transmission.

The means for drivingly coupling the driven bevel gears 95 and 96 to the propeller shaft 104 for completing this forward, neutral, reverse transmission includes a clutching sleeve 116 that has a splined connection to the propeller shaft 104 between the bearings 105 and 106 for rotation with the propeller shaft 104 but axially movable along this shaft. The clutching sleeve 116 has oppositely facing dog clutching surfaces 117 and 118 that are adapted to selectively engage dog clutching teeth 119 and 121 formed on the driven bevel gears 95 and 96, respectively.

The clutching sleeve 116 is adapted to be moved axially along the shaft 104 by means including a pin 122 that extends diametrically through axially extending slots formed in the propeller shaft 104 and which is staked within the clutching sleeve 116. The pin 122 is held in position by means of a torsional spring 123 that is received within a groove 124 formed in the dog clutching sleeve 116.

The pin 122 is, in turn, axially affixed to a shifting sleeve 125 that is slidably supported within a bore of the propeller shaft 104. The clutching sleeve 125 has a tongue and groove connection 126 to a shifting cam 127. The shifting cam 127 is, in turn, slidably supported within a bore 128 of the lower unit housing.

A shifting rod 129 has a crank shaped portion 131 that is received within a slot 132 of the shifting cam 127 for axially moving the cam 127 and shifting sleeve 125 upon rotation of the shifting rod 129. As has been previously noted, the upper end of the shifting rod 129 is appropriately connected to a shaft control mechanism, for example, of the type shown in FIGS. 1 through 4.

A detent mechanism, indicated generally by the reference numeral 133, is provided for holding the dog clutching sleeve 116 in its neutral position and for exerting a force tending to accelerate the movement of the clutching sleeve 116 into its forward or neutral positions. The detent mechanism 113 has a construction of the type as described in the aforenoted copending application Ser. No. 503,570, which has been incorporated herein by reference.

The shifting of this embodiment is believed to be readily clear since the transmission is, for the most part, generally similar to the transmission of the embodiment of FIGS. 1 through 4 and only the thrust taking and bearing arrangement for the propeller shaft is different from the previously described embodiment.

It should be readily apparent from the foregoing description that a relatively compact and yet robust arrangements are provided for taking the forward and reverse driving thrusts of a marine outboard drive transmission and also for insuring that these thrusts are independently transmitted to the propeller shaft housing. In one embodiment, the place of transmission of these thrusts is widely separated from the other in an axial direction.

It is to be understood that the foregoing is only a description of preferred embodiments of the invention and various changes and modifications may be made without departing from the spirit and scope of the invention, as defined by the appended claims.

We claim:

1. In a thrust bearing arrangement for the propeller shaft of a marine outboard drive comprising a lower unit outer housing, a drive shaft supported for rotation within said lower unit housing, a propeller shaft and transmission means for selectively driving said propeller shaft in a forward and reverse direction from said drive shaft, the improvement comprising a first thrust bearing for taking driving thrusts in one direction from said propeller shaft, a second thrust bearing for taking the driving thrusts in the opposite direction from said propeller shaft, and means for transmitting the thrusts from said first and second thrust bearings to said lower unit housing without the thrusts from one of said bearings passing to said outer housing through an element which transfers the thrust from the other of said bearings to said outer housing.

2. In a thrust bearing arrangement as set forth in claim 1 further including a bearing carrier affixed within the lower unit housing and rotatably journaling the propeller shaft.

3. In a thrust bearing arrangement as set forth in claim 2 wherein at least one of the thrust bearings transmits its driving thrust to the lower unit housing through the bearing carrier.

4. In a thrust bearing arrangement as set forth in claim 3 wherein a single thrust flange formed on the propeller shaft engages the first and second thrust bearings.

5. In a thrust bearing arrangement as set forth in claim 4 wherein the bearing carrier provides a pair of axially spaced bearings for rotatably journaling the propeller shaft.

6. In a thrust bearing arrangement as set forth in claim 5 wherein the transmission means comprises a pair of driven bevel gears meshed with opposite sides of a driving bevel gear affixed to the drive shaft and dog clutching means for selectively coupling the driven bevel gears to an intermediate shaft upon which the driven bevel gears are rotatably journaled, means providing a splined coupling between the intermediate shaft and the propeller shaft, the thrust flange being formed on the propeller shaft adjacent said splined connection.

7. In a thrust bearing arrangement as set forth in claim 3 wherein one of the thrust bearings transmits the thrust to the lower unit housing through the bearing carrier, the other of the thrust bearings being effective to transmit its driving thrust to the lower unit housing at a point axially spaced from the bearing carrier.

8. In a thrust bearing arrangement as set forth in claim 7 wherein the first and second thrust bearings are positioned on axially opposite sides of the transmission means.

9. In a thrust bearing arrangement as set forth in claim 1 wherein the transmission means includes a pair of intermeshing bevel gears, at least one of said gears bearing against one of the thrust bearings and applying a force to said one thrust bearing in opposition to the force exerted upon said one thrust bearing by the propeller shaft for limiting the forces transferred from said one thrust bearing to the outer housing.

10. In a thrust bearing arrangement as set forth in claim 6 wherein one of the driven bevel gears transfers its driving thrust to the first of the thrust bearings in a direction opposite to the direction which the propeller shaft transmits its force to said first thrust bearing for minimizing the thrust loading transferred from said first thrust bearing to said outer housing.

11. A thrust bearing arrangement for the propeller shaft of a marine outboard drive comprising a lower unit housing, a drive shaft supported for rotation within said lower unit housing, a propeller shaft, and transmission means for selectively driving said propeller shaft in forward and reverse directions from said drive shaft, the improvement comprising first thrust bearing means for taking the driving thrusts in one direction from said propeller shaft, a second thrust bearing for taking the driving thrust in the opposite direction from said propeller shaft, and means for transmitting the thrust from said first and second thrust bearings to said lower unit housing on opposite sides of said transmission means.

12. A thrust bearing arrangement as set forth in claim 11 wherein the transmission means comprises a driving bevel gear affixed to the drive shaft and a pair of counter-rotating driven bevel gears journaled on the propeller shaft and clutching means for selectively clutching either of said driven bevel gears for rotation with said propeller shaft, said first thrust bearing means being positioned rearwardly of one of said driven bevel gears and said second thrust bearing means being postioned forwardly of the other of said bevel gears.

* * * * *